US008925507B2

(12) United States Patent
Weber

(10) Patent No.: US 8,925,507 B2
(45) Date of Patent: Jan. 6, 2015

(54) CAMSHAFT ADJUSTER

(71) Applicant: Schaeffler Technologies AG & Co. KG, Herzogenaurach (DE)

(72) Inventor: Jurgen Weber, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 5 days.

(21) Appl. No.: 13/711,900

(22) Filed: Dec. 12, 2012

(65) Prior Publication Data

US 2013/0180482 A1 Jul. 18, 2013

(30) Foreign Application Priority Data

Dec. 12, 2011 (DE) ..... 10 2011 008 205

(51) Int. Cl.
*F01L 1/34* (2006.01)
*F01L 1/46* (2006.01)
*F01L 1/344* (2006.01)

(52) U.S. Cl.
CPC *F01L 1/46* (2013.01); *F01L 1/3442* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | | |
|---|---|---|---|---|
| 6,981,477 | B2 * | 1/2006 | Uozaki et al. | 123/90.17 |
| 2003/0051686 | A1 | 3/2003 | Trappe et al. | |
| 2005/0028773 | A1 | 2/2005 | Komaki | |
| 2010/0075765 | A1 | 3/2010 | Isenberg et al. | |
| 2010/0116233 | A1 | 5/2010 | Weisser et al. | |
| 2010/0154732 | A1 | 6/2010 | Bayrakdar | |

FOREIGN PATENT DOCUMENTS

| | | |
|---|---|---|
| DE | 102006002993 | 8/2008 |
| EP | 2166199 | 3/2010 |
| EP | 2184450 | 5/2010 |
| WO | 0161154 | 8/2001 |

* cited by examiner

*Primary Examiner* — Ching Chang
(74) *Attorney, Agent, or Firm* — Volpe and Koenig, P.C.

(57) ABSTRACT

A camshaft adjuster (1) is disclosed that has a spring (4) that is supported by spring supports (5), and these spring supports (5) have lubricant reservoirs (6) for the lubrication of the contact area between the spring wire (10) and the spring support (5).

9 Claims, 4 Drawing Sheets

CAMSHAFT ADJUSTER

CROSS-REFERENCE TO RELATED APPLICATIONS

This application claims the benefit of German Patent Application No, 102011088295.2, filed Dec. 12, 2012, which is incorporated herein by reference as if fully set forth.

FIELD OF THE INVENTION

The invention relates to a camshaft adjuster.

BACKGROUND

Camshaft adjusters are used in internal combustion engines for varying the control times of combustion chamber valves, in order to variably shape the phase relation between the crankshaft and the camshaft in a defined angular range between a maximum advanced position and a maximum retarded position. The adaptation of the control times to the current load and rotational speed reduces fuel consumption and emissions. For this purpose, camshaft adjusters are integrated in a drive train by which a torque is transmitted from the crankshaft to the camshaft. This drive train can be constructed, for example, as a belt, chain, or gearwheel drive.

In a hydraulic camshaft adjuster, the driven element and the drive element form one or more pairs of compression chambers that act opposite to each other and can be charged with hydraulic medium. The drive element and the driven element are arranged coaxially. The filling and emptying of individual compression chambers generates a relative movement between the drive element and the driven element. A spring with a rotational effect between the drive element and the driven element forces the drive element in a preferred direction relative to the driven element. This preferred direction can be in the same direction or opposite the direction of rotation.

One construction of the hydraulic camshaft adjuster is the vane cell adjuster. The vane cell adjuster has a stator, a rotor, and a drive wheel with external teeth. The rotor is constructed as a driven element that can be locked in rotation usually with the camshaft. The drive element includes the stator and the drive wheel. The stator and the drive wheel are locked in rotation with each other or are alternatively constructed as one piece. The rotor is arranged coaxial to the stator and within the stator. With their radially extending vanes, the rotor and the stator form oppositely acting oil chambers that can be charged by oil pressure and allow a relative rotation between the stator and the rotor. The vanes are constructed either integrally with the rotor or the stator or arranged as "connected vanes" in grooves of the rotor or of the stator provided for these vanes. The vane cell adjusters also have various sealing covers. The stator and the sealing covers are secured with each other by several screw connections.

A different construction of the hydraulic camshaft adjuster is the axial piston adjuster. Here, a displacement element is displaced by oil pressure in the axial direction, which generates, through helical gearing, a relative rotation between a drive element and a driven element.

Another construction of a camshaft adjuster is the electromechanical camshaft adjuster that has a triple-shaft gear (for example, a planetary gear). Here, one of the shafts forms the drive element and a second shaft forms the driven element. By means of the third shaft, rotational energy can be fed to the system by a control device, for example, an electric motor or a brake, or energy can be discharged from the system. There can also be a spring that boosts or lessens the relative rotation between the drive element and the driven element.

DE 10 2006 002 993 A1 shows a camshaft adjuster with a chain wheel, a rotor, a housing, and a spring. The housing and the rotor form the work chambers for the relative rotation. The chain wheel is locked in rotation with the housing. The spring is arranged outside of the housing and is largely protected from external contamination and thus from external effects that could shorten the service life by an additional spring cover that is connected to the chain wheel. The rotor has a pin that passes through the housing and provides a support for a spring base of the spring.

SUMMARY

The object of the invention is to provide a camshaft adjuster that increases the service life of the spring.

This objective is met by a device with one or more features of the invention.

Here, it is achieved that the contact between the spring wire of the spring and the spring support is selectively lubricated so that the wear is further minimized. For this purpose, lubricant reservoirs provide and can continue to provide lubricant for the contact point. Thus, a load-bearing lubricant film is established between the spring wire of the spring and the spring support, wherein this lubricant film minimizes the sliding friction that is generated by the relative movement between the spring wire and the spring support. The minimized sliding friction leads to less abrasion on the spring support and/or on the spring wire, wherein the service life of the spring and/or the spring support is significantly increased even if the spring wire and spring support are designed with dimensions close to the load limit.

The particles that are nevertheless generated by the minimized wear are captured by the lubricant reservoir and transported away from the contact point between the spring wire and spring support. This prevents the formation of a suspension consisting of particles and lubricant at the contact point. This suspension would increase the wear more and more with advancing time. The particles are either discharged to the environment away from the contact point between the spring wire and the spring support or can collect in the lubricant reservoir at a point away from the lubricant film, e.g., at the base of the reservoir.

In one construction of the invention, the lubricant reservoir is defined as the area between a two-line contact of the spring wire with the associated spring support. The area between the two line contacts has a distance from the spring to the spring support. The space formed in this way can already contain lubricant or lubricant can be supplied to it. In practice, the term two-line contact also includes a two-point contact that changes into a two-line contact due to the relative movement of the two contact partners according to an advancing operating period. For example, a flat construction of the spring support with a curvature of a spring winding of arbitrary cross section can form such a two-line contact. Alternatively, the flat construction of the spring support can have a curvature that is smaller by a multiple than that of the spring winding. Advantageously, e.g., liquid lubricant can be fed to the lubricant reservoir transverse to the winding direction or to the profile of the spring wire. Thus, fresh lubricant is provided for the lubricant film and at the same time the particles that are nevertheless generated by the minimized wear are discharged or flushed out from the lubricant reservoir.

In one advantageous construction, the lubricant reservoir is constructed as a pocket. A pocket is understood to be any form of recess that is bounded clearly by the lateral surface of the spring support and also has a depth. The shape of the boundary can be square, rectangular, triangular, polygonal, oval, and/or circular and its periphery can be closed or open. Such a pocket can be filled with liquid lubricant or can be filled during the operation. Alternatively, the pocket can already contain a solid lubricant, e.g., graphite. Metals with good sliding properties can be used as the solid lubricant in the pocket.

In one construction of the invention, the lubricant reservoir is constructed as a groove. A groove is similar to the definition of the pocket and likewise has the boundary and the depth, but with the special feature that one dimension of the boundary, the length, is greater by a multiple than the other, and thus defines the direction of the orientation. Furthermore, the periphery of the boundary does not have to be closed. For example, the periphery of the groove is open on a shorter boundary section. The cross section of the groove can assume any shape according to the tool geometry for forming the groove.

The orientation of the groove can be longitudinal, transverse, or inclined relative to the direction of extent of the spring wire of the spring. The length of the groove advantageously does not limit the wire thickness of the spring, but instead projects on both sides or on one side past the spring wire. Thus, advantageously fresh lubricant in liquid form can be added or spent lubricant can be discharged. A plurality of grooves distributed across the area of the contact of the spring to the spring support is advantageous, because the reliability of a single lubrication is distributed to a plurality of lubricant reservoirs.

Advantageously, the arrangement of a groove leaves sufficient lateral surface of the spring support itself on the spring support, so that its allowable load capacity is supported by the lubricant and its wear is minimized.

In one especially preferred construction, the lubricant reservoir constructed as a groove is arranged transverse or inclined relative to the spring wire of the spring. Transverse is close to an angle of 90° between the profile of the spring wire and the longitudinal direction of the groove. An angle of close to 0° corresponds to the term "longitudinal" and "inclined" is to be considered any angle between transverse and longitudinal. In contrast to the longitudinal orientation, advantageously an inclined or transverse profile of the groove is to be selected, because this minimizes the effect wherein the relative movement forces the lubricant from the groove and lubricant can no longer be stored in the lubricant reservoir.

In one preferred construction, the lubricant reservoir constructed as a groove has a circular construction. Circular grooves are especially well suited for spring supports with a rotationally symmetric shape. Circular grooves can have a partially circular or completely circular shape. A completely circular groove, constructed as a channel, has a beginning that is connected to its end. Advantageously, the width of the channel is smaller than that of the spring wire, so that sufficient lateral surface of the spring support remains outside of the groove. Ideally, the channel is arranged within the area of the spring wire projected onto the spring support.

In another construction of the invention, the lubricant reservoir is constructed as a slot. The slot extends as a groove of zero depth through the wall of the spring support. Advantageously, in this way the particles that are generated by the minimized wear can be better discharged or flushed away. The width of the slot is dimensioned so that liquid lubricant can be stored within the slot.

In one construction of the invention, the spring support is constructed as a peg. The peg can have a rotationally symmetric shape. Rotationally symmetric pegs as spring supports can be bumps formed as pins, hub sections or integrally on the drive element or driven element. In addition, pegs can have a diameter offset relative to the spring support. Advantageously, pegs constructed as offset diameters have an implied stop for the spring wire transverse to the direction of extent of the spring wire, so that slippage of the spring wire on the spring support is essentially counteracted. For example, such pegs constructed as offset diameters can be arranged on the free end of an attachment screw and can be used for the spring support. At the same time, the pegs have the constructions of the lubricant reservoirs mentioned above.

In one advantageous construction, the lubricant reservoir is produced by shaping processes. A lubricant reservoir produced by shaping processes has increased strength and this has an especially advantageous effect on the minimization of the wear behavior of the bearing point. At the same time, smoothened surfaces of the bearing point achieve the goal of further minimizing the abrasion.

In one preferred construction of the invention, the lubricant reservoir is constructed as a solid lubricant body. This solid lubricant body can be stored in a receptacle, such as a groove, pocket, or something similar to that described above, and can remain in this receptacle over the service life of the camshaft adjuster. Solid lubricants can be metals with good sliding properties, graphite, carbon embedded through case hardening, or coatings. The lubricant body as a lubricant reservoir can be constructed either as a component that is separate from the spring support, e.g., as a sleeve, ring, plate, or as a lubricant reservoir that is constructed integrally with the spring support. This construction can be expanded by the materials and/or constructions named above.

The arrangement of a lubricant reservoir in the contact point between the spring wire and spring support increases the service life of the spring and spring support and minimizes the friction at the contact point.

BRIEF DESCRIPTION OF THE DRAWINGS

Embodiments of the invention are shown in the figures. Shown are.

DETAILED DESCRIPTION OF THE PREFERRED EMBODIMENTS

Figure 1:
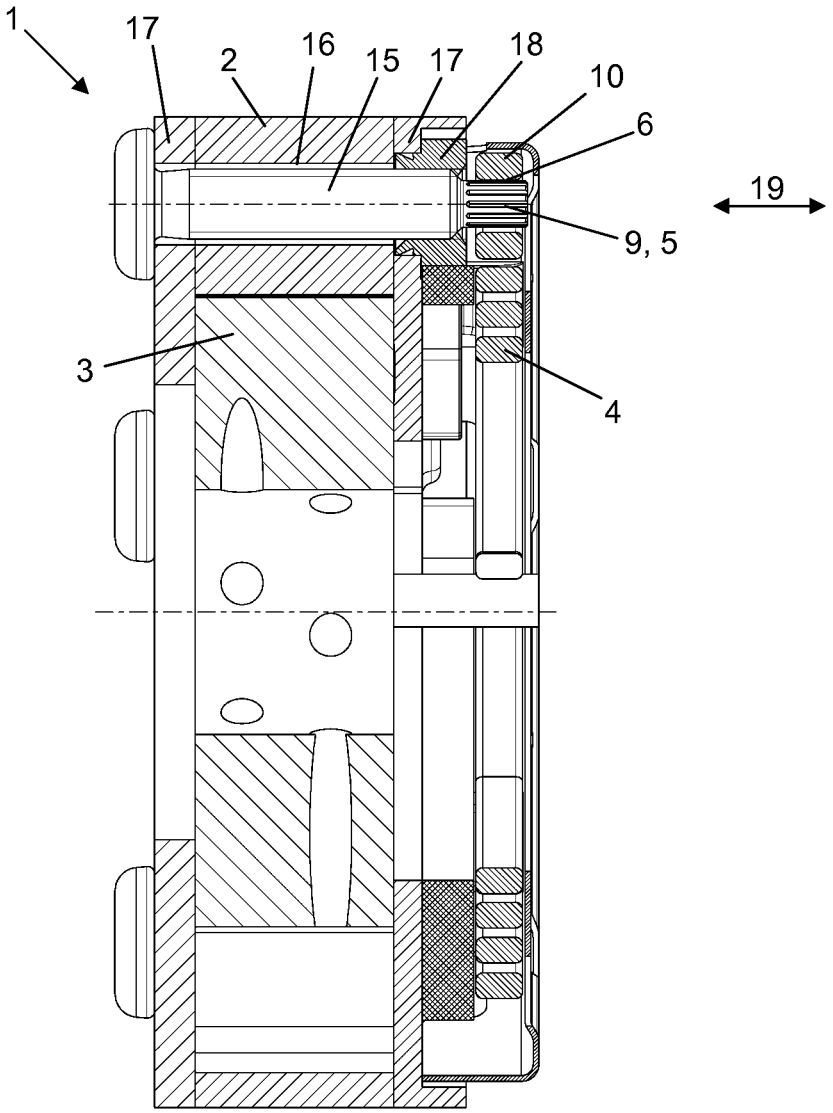
FIG. 1 is a section view through a camshaft adjuster with the lubricant reservoir according to the invention.

FIG. 1 shows a section through a camshaft adjuster 1 with the lubricant reservoir 6 according to the invention. The function and the structure of the camshaft adjuster 1, especially in a vane cell construction, with the drive element 2 and the driven element 3, is sufficiently well known from the prior art. This camshaft adjuster 1 is provided with a spring 4 that supports the relative rotation between the drive element 2 and the driven element 3 in at least one direction of rotation. The spring 4 is supported by spring supports 5 of the drive element 2 and the driven element 3. The spring supports 5 are connected rigidly on the drive element 2 and on the driven element 3.

In this embodiment, a screw 15 has the spring support 5. The screw 15 passes through an opening 16 of the drive element 2 and connects the side cover 17 to the drive element 2 in a rotationally locked manner. For this purpose, a nut 18 is anchored in one of the side covers 17 that has the matching thread for the screw 15. A peg 9 of the screw 15 is constructed on the end facing away from the screw head of the screw 15. The peg 9 has a smaller diameter than the thread of the screw 15 and has a rotationally symmetric construction. The peg 9 is provided as a spring support 5 with several grooves 7 extending in the axial direction 19 and distributed on the periphery of the peg 9. The grooves 7 are constructed as lubricant reservoirs 6. Additional details of the spring support 5 follow below in FIG. 2.

Figure 2:
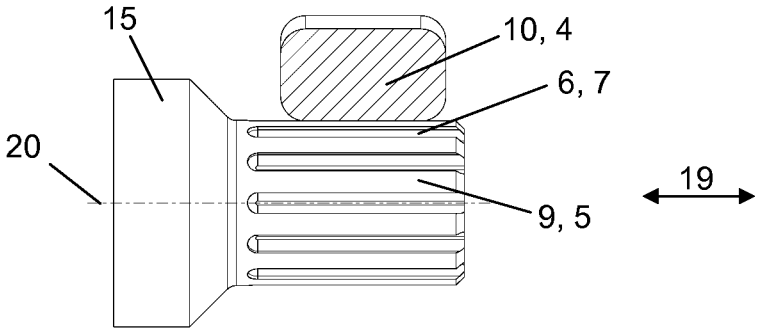
FIG. 2 is a detailed view of the lubricant reservoir according to FIG. 1.

FIG. 2 shows a detailed view of the lubricant reservoir 6 according to FIG. 1. The grooves 7 constructed as lubricant reservoirs 6 are arranged distributed uniformly over the periphery of the peg 9. Advantageously, through this distribution, a separate alignment of the grooves 7 for the contact between the spring wire 10 and spring support 5 after screwing in the screw 15 into the nut 18 is not necessary. The grooves 7 have an open construction on the free end of the peg 9 in the axial direction 19. The lubricant reservoirs 6 are arranged, in particular, in contact between the spring wire 10 of the spring 4 and the spring support 5.

These lubricant reservoirs 6 store oil or lubricant that lubricates the contact between the spring wire 10 and spring support 5. As an alternative to oil or lubricant, solid lubricants, such as graphite, could also be stored. Either the lubricants stored in the lubricant reservoir 6 are placed before the installation of the camshaft adjuster 1 or the lubricant reservoir 6 is designed for the storage of leakage oil from the camshaft adjuster 1 during operation.

Instead of a screw 15, the peg 9 could also be constructed by a pin or integrally with one of the side covers 17, the nut 18, the drive element 2, or the driven element 3. The difference in diameters mentioned at the beginning between peg 9 and, e.g., the screw 15 can be eliminated. Advantageously, however, a stop for the spring wire 10 can be constructed in the axial direction 19 by the difference in diameters.

Figure 3:
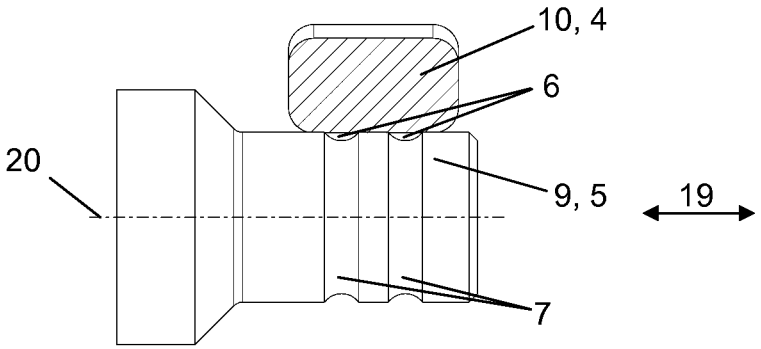
FIG. 3 is a view of a first, alternative construction of the lubricant reservoir according to FIG. 2.

FIG. 3 shows a first, alternative construction of the lubricant reservoir 6 according to FIG. 2. Here, the grooves 7 constructed as lubricant reservoirs 6 are constructed in the peripheral direction about the axis of symmetry 20 of the peg 9 or the spring support 5. Two grooves 7 set apart from each other in the axial direction 19 provide the lubricant reservoir 6 in the contact region between the spring wire 10 and spring support 5. The grooves 7 can have cross-sectional shapes that are different from each other or, as shown in the embodiment, the same cross-sectional shape. In this embodiment it can be easily seen that the contact length between the spring wire 10 and spring support 5 in the axial direction 19 is indeed broken by the grooves 7, but the load is distributed onto the peripheral surface of the spring support 5 and onto the lubricant in the lubricant reservoir 6. This results in especially advantageous lubrication and therefore an increase in the bearing capacity and the service life. As already mentioned in FIG. 2, the lubricant can be inserted before the installation or during operation.

Figure 4:
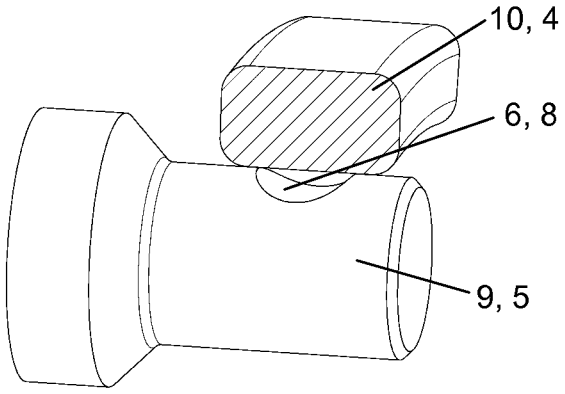
FIG. 4 is a view of a second, alternative construction of the lubricant reservoir according to FIG. 2.

FIG. 4 shows a second, alternative construction of the lubricant reservoir 6 according to FIG. 2. This lubricant reservoir 6 is constructed as a pocket 8. The peripheral surface of the peg 9 or the spring support 5 is different from the original peripheral surface with respect to the axis of symmetry 20, so that a type of trough or pocket 8 is constructed. This pocket 8 has the lubricant reservoir 6. Preferably, this pocket 8 is constructed on a pin or a peg 9 constructed integrally with the peripheral components. A construction on a screw 15 has proven disadvantageous in this respect, because during the screwing in of the screw 15, the orientation of the pocket 8 to the contact with the spring wire 10 must be ensured. As already mentioned in FIG. 2, the lubricant can be inserted before the installation or during operation.

Figure 5:
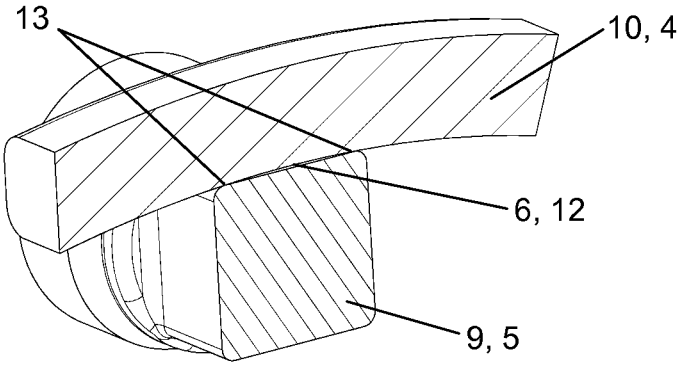
FIG. 5 is a view of a third, alternative construction of the lubricant reservoir according to FIG. 2.

FIG. 5 shows a third, alternative construction of the lubricant reservoir 6 according to FIG. 2. Here, the spring support 5 is constructed as a square. Very different polygonal shapes are conceivable. The lubricant reservoir 6 is constructed as a region 12 between a two-line contact 13. The two-line contact 13 is produced by the curvature of the spring wire 10 and the flat construction of the spring support 5. The region 12 to the two-line contact 13 is constructed by the curvature of the spring wire 10 as a hollow space in which lubricant is stored. As already mentioned in FIG. 2, the lubricant can be inserted before the installation or during operation.

Figure 6:
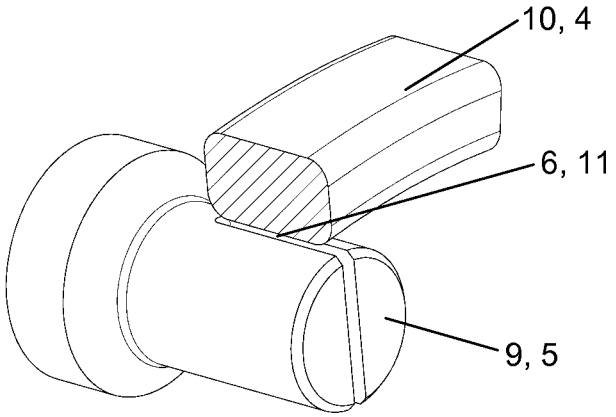
FIG. 6 is a view of a fourth, alternative construction of the lubricant reservoir according to FIG. 2.

FIG. 6 shows a fourth, alternative construction of the lubricant reservoir 6 according to FIG. 2. The lubricant reservoir 6 is constructed as a slot 11 of the spring support 5. The slot 11 extends in the radial direction through the entire spring support 5. The orientation of the slot 11 relative to the spring wire 10 is selected so that an open side of the slot 11 stands opposite the spring wire 10 in the contact between the spring wire 10 and spring support 5. As already mentioned in FIG. 2, the lubricant can be inserted before the installation or during operation.

Figure 7:
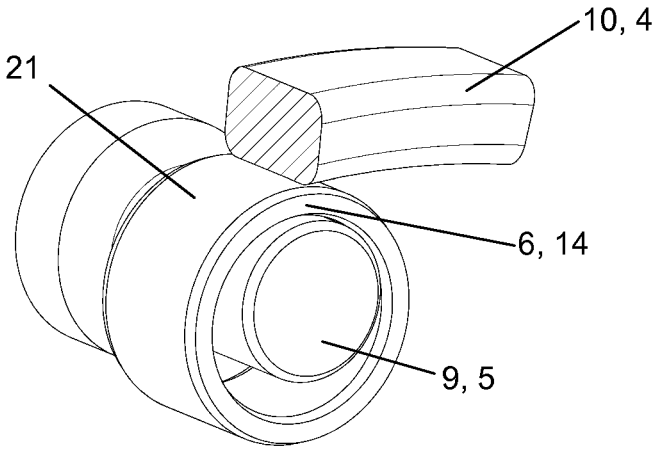
FIG. 7 is a view of a fifth, alternative construction of the lubricant reservoir according to FIG. 2.

FIG. 7 shows a fifth, alternative construction of the lubricant reservoir 6 according to FIG. 2. An additional component 21 having the lubricant reservoir 6 is arranged between the spring support 5 and the spring wire 10. This component 21 that has an annular construction here has a greater diameter than the spring support 5 that is constructed as a rotationally symmetric peg 9. Through the favorable curvature of the component 21 resulting from the construction relative to the curvature of the spring wire 10, the Hertzian contact stress is minimized. At the same time, the Hertzian contact stress between the component 21 and the spring support 5 is minimized due to the, in turn, favorable curvatures of the spring support 5 and component 21. The component 21 can advantageously have a solid lubricant. For this purpose there are materials, such as graphite or metals with good sliding characteristics, such as non-ferrous metals. Another variant is to construct the component 21 from a sintered material and to infiltrate it with the lubricant.

LIST OF REFERENCE NUMBERS

1) Camshaft adjuster
2) Drive element
3) Driven element
4) Spring
5) Spring support
6) Lubricant reservoir
7) Groove
8) Pocket
9) Peg
10) Spring wire
11) Slot
12) Region
13) Two-line contact
14) Solid lubricant
15) Screw
16) Opening

17) Side cover
18) Nut
19) Axial direction
20) Axis of symmetry
21) Component

The invention claimed is:

1. A camshaft adjuster comprising a drive element, a driven element, and a spring, the drive element and the driven element are rotatable relative to each other, the spring is fixed by a spring support of the drive element or the driven element, the spring radially engages against an engagement surface of the spring support, a groove extends into the engagement surface of the spring support, the spring supports a relative rotation between the drive element and the driven element, and a lubricant reservoir is provided between a spring wire of the spring and the groove of the engagement surface of the spring support, in order to lubricate a contact area between the spring wire and the spring support.

2. The camshaft adjuster according to claim 1, wherein the lubricant reservoir is defined as a region between a two-line contact of the spring wire with the spring support.

3. The camshaft adjuster according to claim 1, wherein the lubricant reservoir comprises a pocket.

4. The camshaft adjuster according to claim 1, wherein the lubricant reservoir groove is arranged transverse or inclined relative to the spring wire.

5. The camshaft adjuster according to claim 1, wherein the lubricant reservoir groove has a circular construction.

6. The camshaft adjuster according to claim 1, wherein the lubricant reservoir comprises a slot.

7. The camshaft adjuster according to claim 1, wherein the spring support comprises a peg.

8. The camshaft adjuster according to claim 1, wherein the lubricant reservoir is produced by shaping processes.

9. The camshaft adjuster according to claim 1, wherein the lubricant reservoir is constructed as a solid lubricant body.

* * * * *